US012053127B2

(12) United States Patent
Ren

(10) Patent No.: US 12,053,127 B2
(45) Date of Patent: Aug. 6, 2024

(54) DEVICE FOR RAPIDLY DISASSEMBLING TOILET LID AND TOILET LID

(71) Applicant: Xiamen Beewill Sanitary Co., Ltd., Xiamen (CN)

(72) Inventor: Shisong Ren, Xiamen (CN)

(73) Assignee: Xiamen Beewill Sanitary Co., Ltd., Xiamen (CN)

( * ) Notice: Subject to any disclaimer, the term of this patent is extended or adjusted under 35 U.S.C. 154(b) by 322 days.

(21) Appl. No.: 17/588,220

(22) Filed: Jan. 29, 2022

(65) Prior Publication Data

US 2023/0009498 A1 Jan. 12, 2023

(30) Foreign Application Priority Data

Jul. 9, 2021 (CN) ..... 202110780858.4

(51) Int. Cl.
*A47K 13/12* (2006.01)

(52) U.S. Cl.
CPC ..... *A47K 13/12* (2013.01)

(58) Field of Classification Search
CPC ..... A47K 13/12
See application file for complete search history.

(56) References Cited

FOREIGN PATENT DOCUMENTS

| | | | |
|---|---|---|---|
| CN | 201861549 U | * | 6/2011 |
| CN | 202908608 U | * | 5/2013 |
| CN | 203709930 U | * | 7/2014 |

* cited by examiner

*Primary Examiner* — Christine J Skubinna

(57) ABSTRACT

A device for rapidly disassembling a toilet lid and a toilet lid includes a rotating member, a push rod, a pull rod and an elastic member. The rotating member is rotatably arranged. The push rod is axially movably arranged on a first side of the rotating member and is connected to a first connecting position of the rotating member. The pull rod is axially movably arranged on a second side, opposite the first side, of the rotating member. One end of the pull rod is connected to a second connecting position of the rotating member, and the other end of the pull rod is provided with a rotating shaft connected to a toilet bowl. When the push rod axially moves towards a first direction to drive the rotating member to rotate, the rotating member pulls the pull rod to axially move towards a second direction opposite the first direction.

14 Claims, 9 Drawing Sheets

DEVICE FOR RAPIDLY DISASSEMBLING TOILET LID AND TOILET LID

CROSS REFERENCE TO THE RELATED APPLICATIONS

This application is based upon and claims priority to Chinese Patent Application No. 202110780858.4, filed on Jul. 9, 2021, the entire contents of which are incorporated herein by reference.

TECHNICAL FIELD

The present disclosure relates to the technical field of bathroom equipment, in particular to a device for rapidly disassembling a toilet lid and a toilet lid.

BACKGROUND

In general, a toilet includes a toilet bowl and a toilet lid detachably arranged thereon, the toilet lid usually including an upper cover and a toilet seat which are hinged with each other. The toilet lid is provided with a rotating shaft, through which the toilet lid is rotatably arranged on the toilet bowl.

In long-term use of the toilet, the toilet lid is likely to be broken and needs to be disassembled for repair or replacement, so it is extremely necessary to rapidly assemble or disassemble the toilet lid and the toilet bowl.

SUMMARY

The present disclosure aims to solve at least to some extent one of the technical problems in the above art. Therefore, one object of the present disclosure is to provide a device for rapidly disassembling a toilet lid, by means of which, a toilet lid and a toilet bowl may be rapidly assembled or disassembled by driving a rotating shaft to stretch out or draw back.

A second object of the present disclosure is to provide the toilet lid including the device for rapidly disassembling a toilet lid.

In order to achieve the above objects, the embodiment of a first aspect of the present disclosure provides the device for rapidly disassembling a toilet lid. The device includes:

- a rotating member rotatably arranged;
- a push rod which is axially movably arranged on a first side of the rotating member and is connected to a first connecting position of the rotating member;
- a pull rod which is axially movably arranged on a second side, opposite the first side, of the rotating member, wherein one end of the pull rod is connected to a second connecting position of the rotating member, the other end of the pull rod is provided with a rotating shaft connected to a toilet bowl, and when the push rod axially moves towards a first direction to drive the rotating member to rotate, the rotating member pulls the pull rod to axially move towards a second direction opposite the first direction; and
- an elastic member which acts on the push rod to provide a return force for the push rod.

According to the device for rapidly disassembling a toilet lid of the embodiment of the present disclosure, the push rod axially moves towards the first direction to drive the rotating member to rotate, for example, when the push rod axially moves towards the pull rod, the push rod drives the rotating member to rotate. The rotating member pulls the pull rod to axially move towards the second direction opposite the first direction, that is, the pull rod axially moves towards the push rod, and then, the rotating shaft of the pull rod draws back to rapidly disassemble the toilet lid.

Under the circumstance that the elastic member acts on the push rod, the push rod axially moves towards the first direction to drive the rotating member to rotate, for example, when the push rod axially moves away from the pull rod, the push rod drives the rotating member to rotate. The rotating member pulls the pull rod to axially move towards the second direction opposite the first direction, that is, the pull rod axially moves away from the push rod, and then, the rotating shaft of the pull rod stretches out to rapidly assemble the toilet lid and the toilet bowl.

Therefore, according to the present disclosure, the push rod acts on the rotating member, and the rotating member acts on the pull rod to drive the rotating shaft to stretch out or draw back, so as to rapidly assemble or disassemble the toilet lid and the toilet bowl.

In addition, the device for rapidly disassembling a toilet lid provided according to the above embodiment of the present disclosure may further has the following additional technical features:

Optionally, the rotating member is set as a gear, the push rod is provided with a first rack meshing with the first connecting position of the rotating member, and one end of the pull rod is provided with a second rack meshing with the second connecting position of the rotating member.

Optionally, the rotating member is set as a rotating rod, a middle portion of the rotating member is rotatable, one end of the rotating member is hinged with the push rod, and the other end of the rotating member is hinged with one end of the pull rod.

Optionally, the rotating member is set as a rotating disc, a first sliding rod and a second sliding rod are arranged, in an axial direction, on the rotating member separately, a first transverse sliding groove for the first sliding rod to slide therein is provided on the push rod, and one end of the pull rod is provided with a second transverse sliding groove for the second sliding rod to slide therein.

Optionally, the rotating member rotates around a pin fixedly arranged.

Optionally, a connecting line between the first sliding rod and the second sliding rod is connected to a rotation center of the rotating member, and the first sliding rod and the second sliding rod are positioned at two sides of the rotation center of the rotating member respectively.

Optionally, the push rod is separately arranged and includes a button and a first claw which are connected fixedly, and the first transverse sliding groove is provided in the first claw.

Optionally, the pull rod is separately arranged and includes a connecting rod and a second claw which are connected fixedly, the rotating shaft is arranged on the connecting rod, and the second transverse sliding groove is provided in the second claw.

Optionally, the first transverse sliding groove and the second transverse sliding groove are open grooves.

Optionally, the first transverse sliding groove and the second transverse sliding groove are closed grooves.

Optionally, a width of the first transverse sliding groove is greater than or equal to a distance between the second sliding rod and the rotation center of the rotating member, and a width of the second transverse sliding groove is greater than or equal to a distance between the first sliding rod and the rotation center of the rotating member.

Optionally, the device further includes a fixing sleeve, an axial through hole is formed in the fixing sleeve, the rotating member, the push rod and the pull rod are accommodated in the through hole, one end of the elastic member abuts against the fixing sleeve, and the other end of the elastic member abuts against the push rod.

In order to achieve the above objects, the embodiment of a second aspect of the present disclosure provides a toilet lid, where an axial mounting hole is provided in the toilet lid, and the device for rapidly disassembling a toilet lid is arranged in the axial mounting hole.

The toilet lid according to the embodiment of the present disclosure includes the device for rapidly disassembling a toilet lid. The push rod axially moves towards the first direction to drive the rotating member to rotate, for example, when the push rod axially moves towards the pull rod, the push rod drives the rotating member to rotate. The rotating member pulls the pull rod to axially move towards the second direction opposite the first direction, that is, the pull rod axially moves towards the push rod, and then, the rotating shaft of the pull rod draws back to rapidly disassemble the toilet lid.

Under the circumstance that the elastic member acts on the push rod, the push rod axially moves towards the first direction to drive the rotating member to rotate, for example, when the push rod axially moves away from the pull rod, the push rod drives the rotating member to rotate. The rotating member pulls the pull rod to axially move towards the second direction opposite the first direction, that is, the pull rod axially moves away from the push rod, and then, the rotating shaft of the pull rod stretches out to rapidly assemble the toilet lid and the toilet bowl.

Therefore, according to the present disclosure, the push rod acts on the rotating member, and the rotating member acts on the pull rod to drive the rotating shaft to stretch out or draw back, so as to rapidly assemble or disassemble the toilet lid and the toilet bowl.

BRIEF DESCRIPTION OF THE NUMBERS

Figure 1:
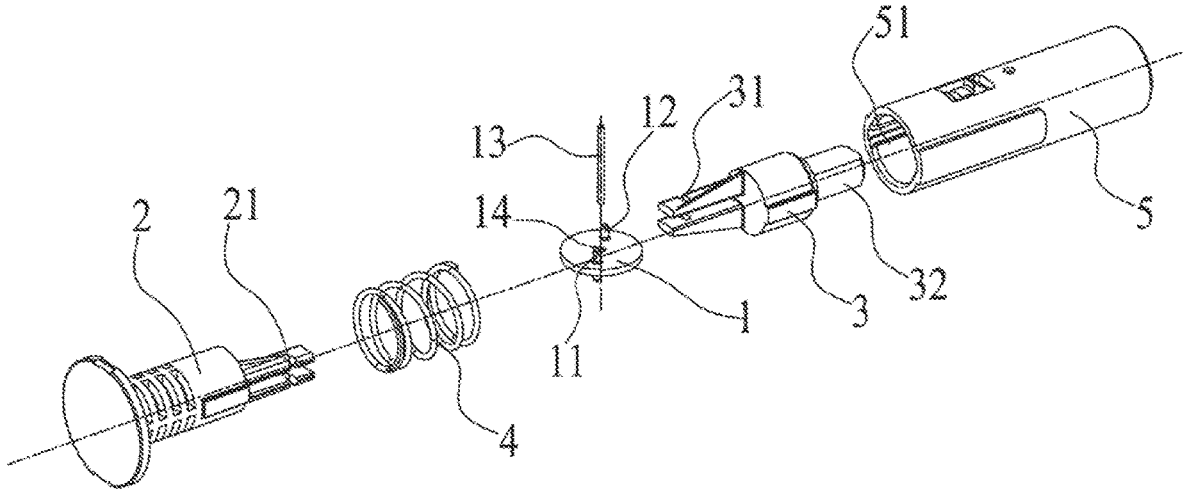
FIG. 1 is a three-dimensional exploded view according to Embodiment 1 of the present disclosure.
Figure 2:
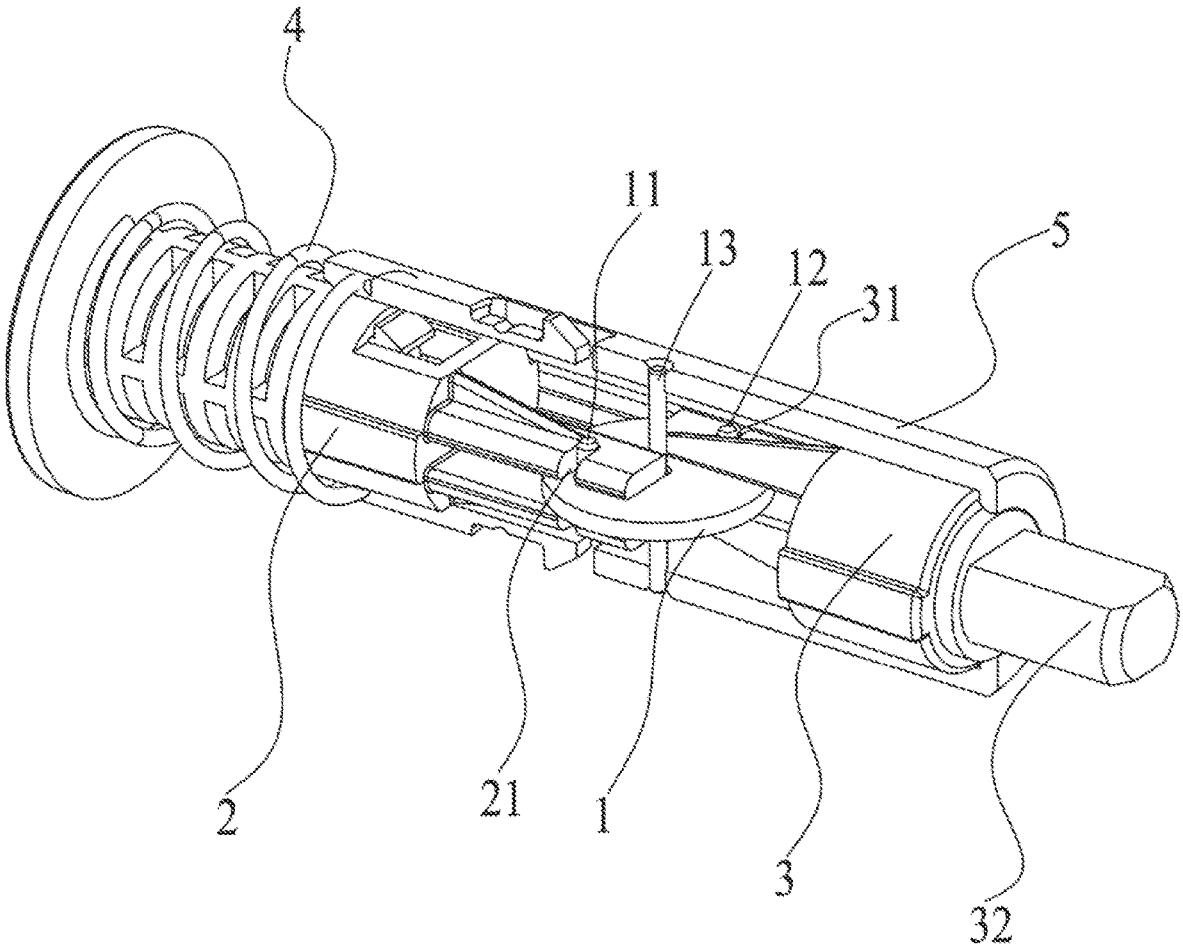
FIG. 2 is a three-dimensional combined view (in a state that a rotating shaft stretches out) according to Embodiment 1 of the present disclosure.
Figure 3:
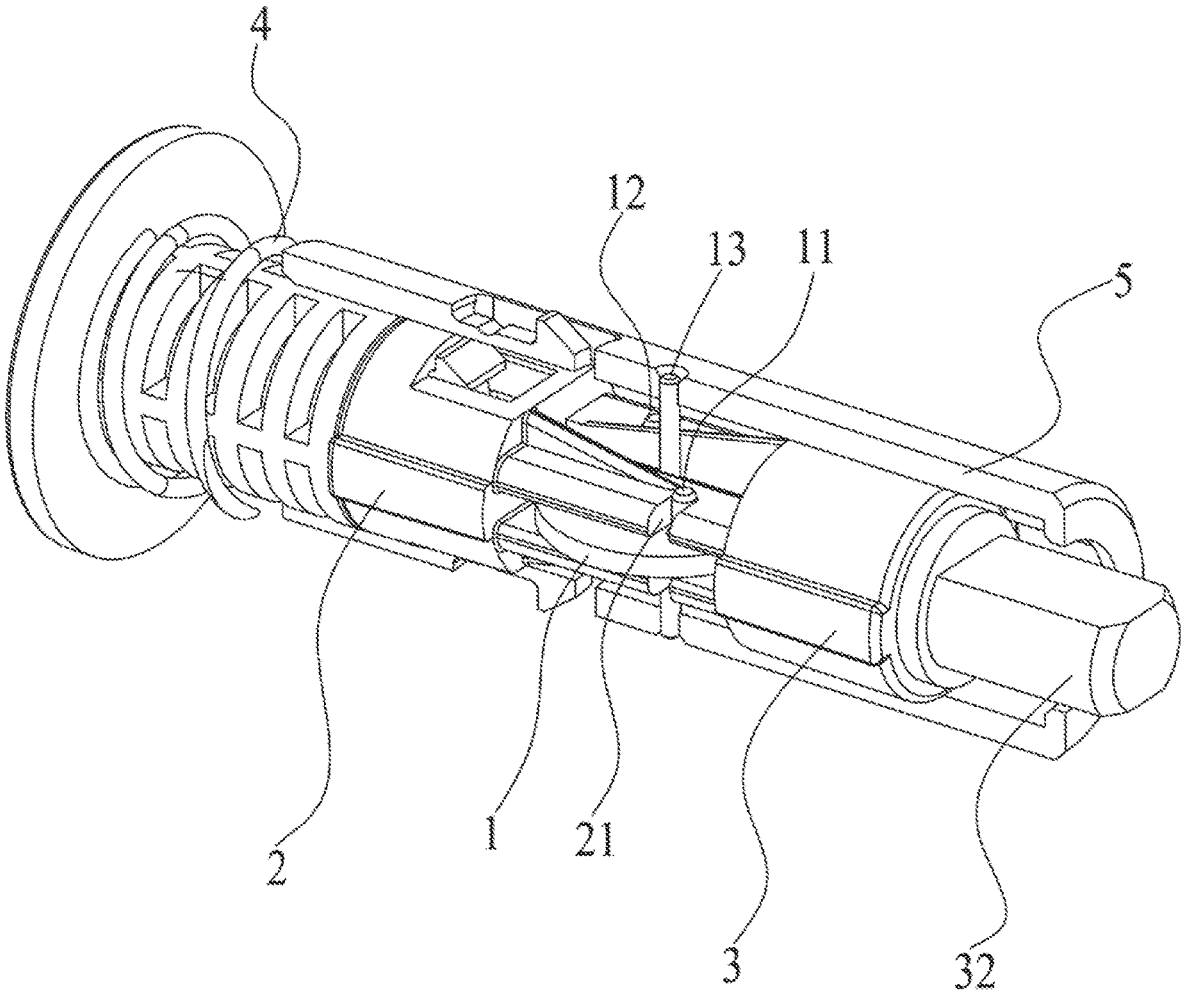
FIG. 3 is a three-dimensional combined view (in a state that the rotating shaft draws back) according to Embodiment 1 of the present disclosure.
Figure 4:
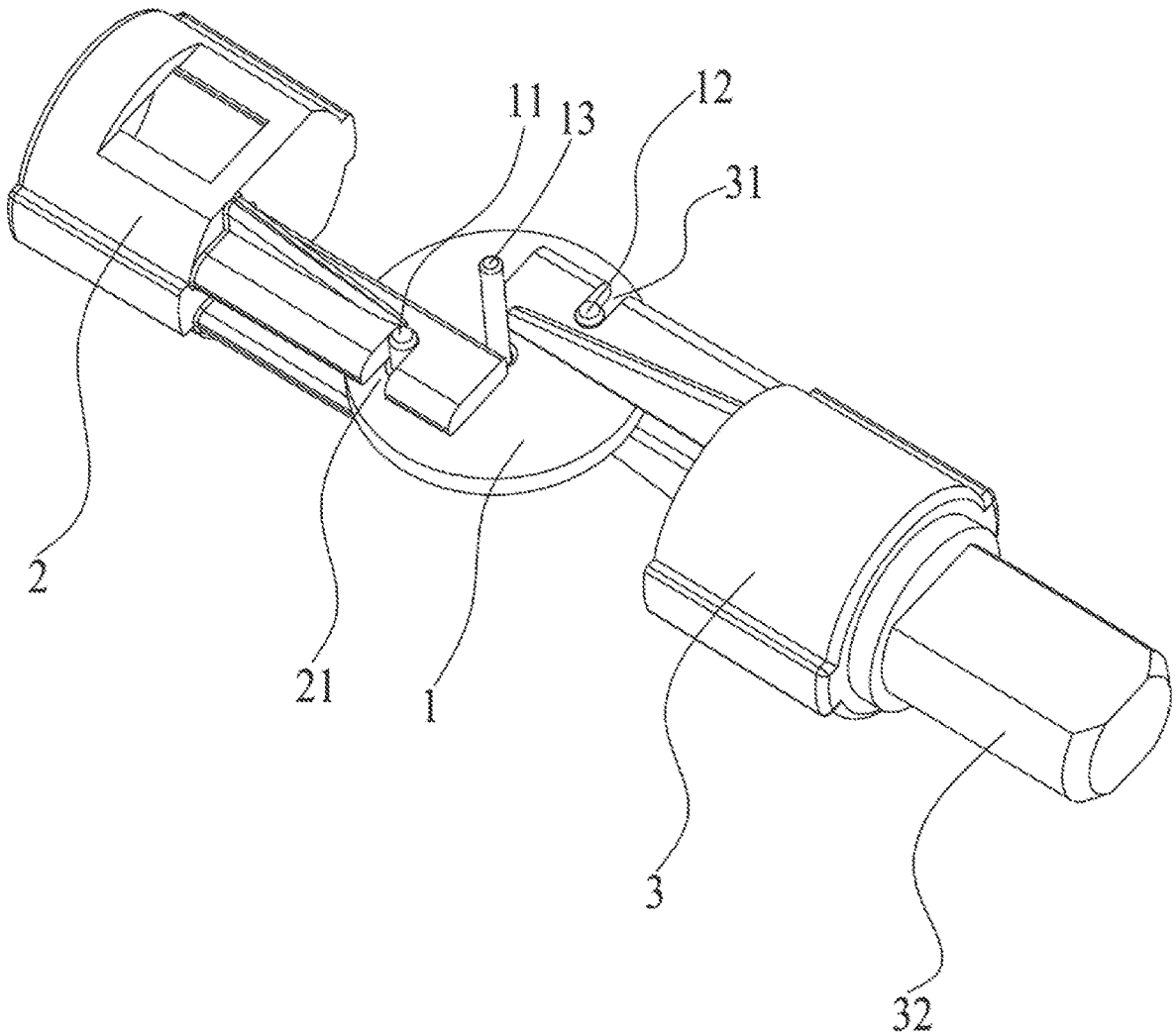
FIG. 4 is a schematic diagram (in the state that the rotating shaft stretches out) of an internal structure according to Embodiment 1 of the present disclosure.
Figure 5:
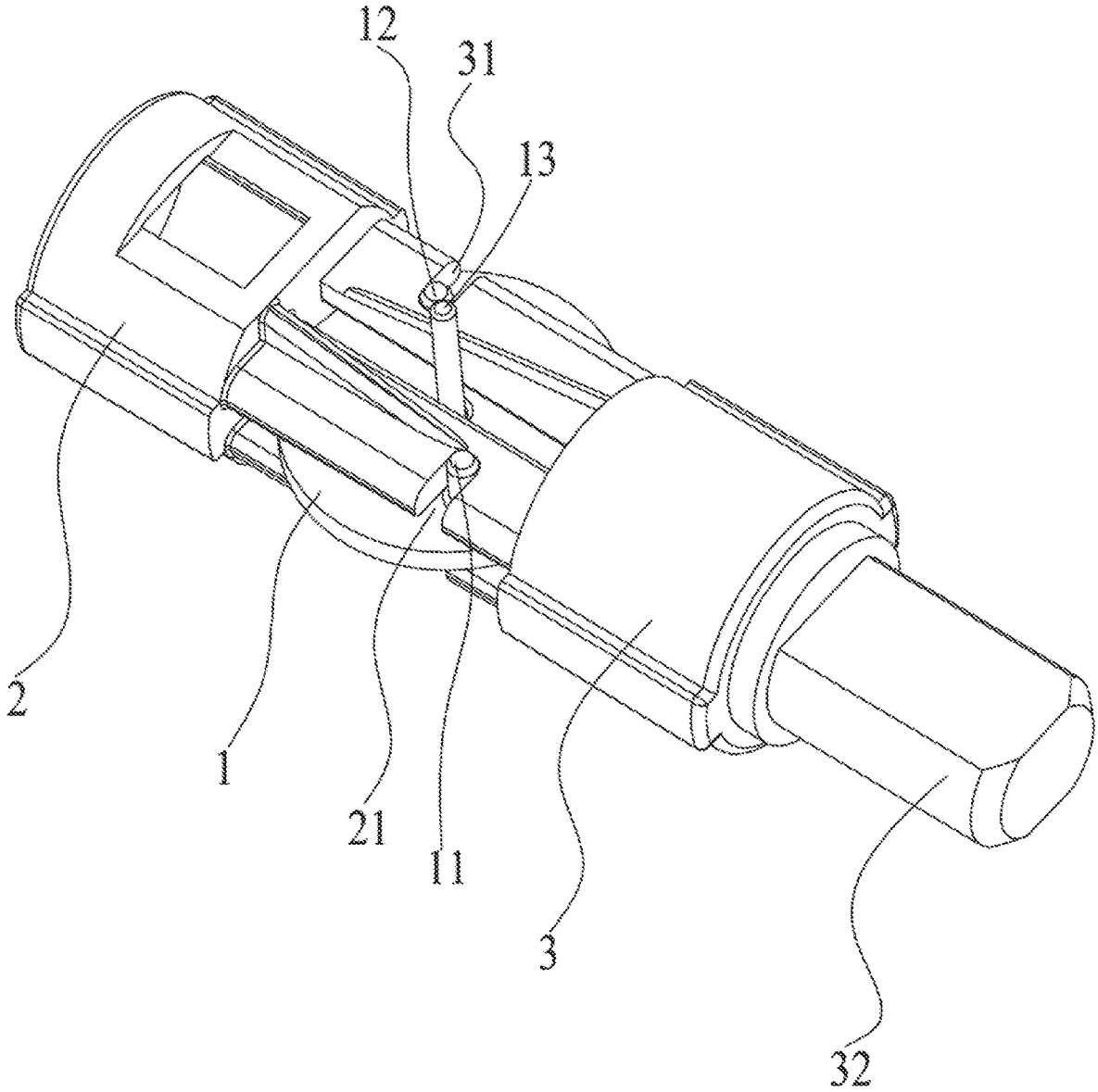
FIG. 5 is a schematic diagram (in the state that the rotating shaft draws back) of the internal structure according to Embodiment 1 of the present disclosure.

Rotating member 1 First sliding rod 11
Second sliding rod 12 Pin 13
Rotation center 14 Push rod 2
First transverse sliding groove 21 Button 22
First claw 23 Pull rod 3
Second transverse sliding groove 31 Rotating shaft 32
Connecting rod 33 Second claw 34
Elastic member 4 Fixing sleeve 5
Through hole 51 Toilet lid 6
Upper cover 61 Toilet seat 62
Axial mounting hole 63

DETAILED DESCRIPTION OF THE EMBODIMENTS

The embodiments of the present disclosure will be described in detail below, examples of the embodiments are shown in the accompanying drawings, throughout which identical or similar reference numerals denote identical or similar elements or elements having identical or similar functions. The embodiments described with reference to the accompanying drawings are exemplary and intended to explain the present disclosure, instead of being construed as limiting the present disclosure.

A device for rapidly disassembling a toilet lid disclosed in the present disclosure includes a rotating member, a push rod, a pull rod and an elastic member; the rotating member is rotatably arranged; the push rod is axially movably arranged on a first side of the rotating member and is connected to a first connecting position of the rotating member; the pull rod is axially movably arranged on a second side, opposite the first side, of the rotating member, and one end of the pull rod is connected to a second connecting position of the rotating member; the other end of the pull rod is provided with a rotating shaft connected to a toilet bowl, and when the push rod axially moves towards a first direction to drive the rotating member to rotate, the rotating member pulls the pull rod to axially move towards a second direction opposite the first direction; and the elastic member acts on the push rod to provide a return force for the push rod. According to the present disclosure, the toilet lid and the toilet bowl may be rapidly assembled or disassembled by driving the rotating shaft to stretch out or draw back.

In order to better understand the above technical solution, the exemplary embodiments of the present disclosure will be described in more detail below with reference to the accompanying drawings. While the exemplary embodiments of the present disclosure are shown in the accompanying drawings, it should be understood that the present disclosure may be realized in various forms and should not be limited by the embodiments set forth herein. In contrast, the embodiments are provided to provide a more thorough understanding of the present disclosure and to fully convey the scope of the present disclosure to those skilled in the art.

In order to better understand the above technical solution, the above technical solution will be described in detail in conjunction with the accompanying drawings and the specific embodiments.

As shown in FIGS. 1-5, the device for rapidly disassembling a toilet lid disclosed in Embodiment 1 of the present disclosure includes the rotating member 1, the push rod 2, the pull rod 3 and the elastic member 4.

The rotating member 1 is rotatably arranged. In the embodiment, the rotating member 1 is set as a rotating disc, a first sliding rod 11 and a second sliding rod 12 are arranged, in an axial direction, on the rotating member 1 separately. Optionally, the first sliding rod 11 and the second sliding rod 12 extend from a first face of the rotating member 1 to a second face opposite the first face.

Optionally, the rotating member 1 rotates around a pin 13 fixedly arranged. When the device for rapidly disassembling a toilet lid includes a fixing sleeve 5, the pin 13 is fixed in the fixing sleeve 51; and when the device for rapidly disassembling a toilet lid does not include the fixing sleeve 5, the pin 13 is fixed in an axial mounting hole of the toilet lid.

Optionally, a connecting line between the first sliding rod 11 and the second sliding rod 12 is connected to a rotation center 14 of the rotating member 1, and the first sliding rod 11 and the second sliding rod 12 are positioned at two sides of the rotation center 14 of the rotating member 1 respectively.

Optionally, the rotating member 1 may be a rotating disc and set in a circular shape, and of course, the rotating member 1 may also be in other shapes, such as a strip shape, an oval shape, etc. A distance between the first sliding rod 11 and the pin 13 and a distance between the second sliding rod 12 and the pin 13 may be unequal, so as to realize unequal distance transform between a pressing stroke of a button and a drawing back stroke of the rotating shaft.

The push rod 2 is axially movably arranged on a first side of the rotating member 1, and a first transverse sliding groove 21 for the first sliding rod 11 to slide therein is provided in the push rod 2. When the device for rapidly disassembling a toilet lid includes the fixing sleeve 5, the push rod 2 is axially movably arranged in the fixing sleeve 5; and when the device for rapidly disassembling a toilet lid does not include the fixing sleeve 5, the push rod 2 is directly axially movably arranged in the axial mounting hole of the toilet lid.

Optionally, two first transverse sliding grooves 21 are provided upon and down, and an avoiding space for the rotating member 1 is provided between the two first transverse sliding grooves 21, such that two sides of the first sliding rod 11 slide in the two first transverse sliding grooves 21 respectively, and the push rod 2 may drive the rotating member 1 to rotate relatively stably.

Optionally, the first transverse sliding groove 21 is an open groove, and of course, the first transverse sliding groove 21 may also be a closed groove. A width of the first transverse sliding groove 21 is greater than or equal to a distance between the second sliding rod 12 and the rotation center 14 of the rotating member 1. Preferably, the first transverse sliding groove 21 is perpendicular to a body of the push rod 2, such that the width of the first transverse sliding groove 21 may be set smaller. Of course, the first transverse sliding groove 21 and the body of the push rod 2 may be inclined.

The pull rod 3 is axially movably arranged on a second side, opposite the first side, of the rotating member 1, one end of the pull rod 3 is provided with a second transverse sliding groove 31 for the second sliding rod 12 to slide therein, and the other end of the pull rod 3 is provided with a rotating shaft 32 connected to the toilet bowl. When the push rod 2 axially moves in a first direction to drive the rotating member 1 to rotate, the rotating member 1 pulls the pull rod 3 to axially move in a second direction opposite the first direction.

Optionally, two second transverse sliding grooves 31 are provided up and down, and the avoiding space for the rotating member 1 is provided between the two second transverse sliding grooves 31, such that the two second transverse sliding grooves 31 allow two sides of the second sliding rod 12 to slide respectively, and the rotating member 1 may drive the pull rod 3 to axially move relatively stably.

Optionally, the second transverse sliding groove 31 is an open groove, and of course, may also be a closed groove. A width of the second transverse sliding groove 31 is greater than or equal to a distance between the first sliding rod 11 and the rotation center 14 of the rotating member 1. Preferably, the second transverse sliding groove 31 is perpendicular to a body of the pull rod 3, such that the width of the second transverse sliding groove 31 may be set relatively small. Of course, an oblique angle may be formed between the second transverse sliding groove 31 and the body of the pull rod 3.

The elastic member 4 acts on the push rod 2 to provide a return force for the push rod 2. Optionally, the elastic member 4 is a spring. When the device for rapidly disassembling a toilet lid include the fixing sleeve 5, one end of the elastic member 4 abuts against the fixing sleeve 5, and the other end of the elastic member 4 abuts against the push rod 2. When the device for rapidly disassembling a toilet lid does not include the fixing sleeve 5, one end of the elastic member 4 abuts against a side wall of the axial mounting hole of the toilet lid, and the other end of the elastic member 4 abuts against the push rod 2.

Figure 8:
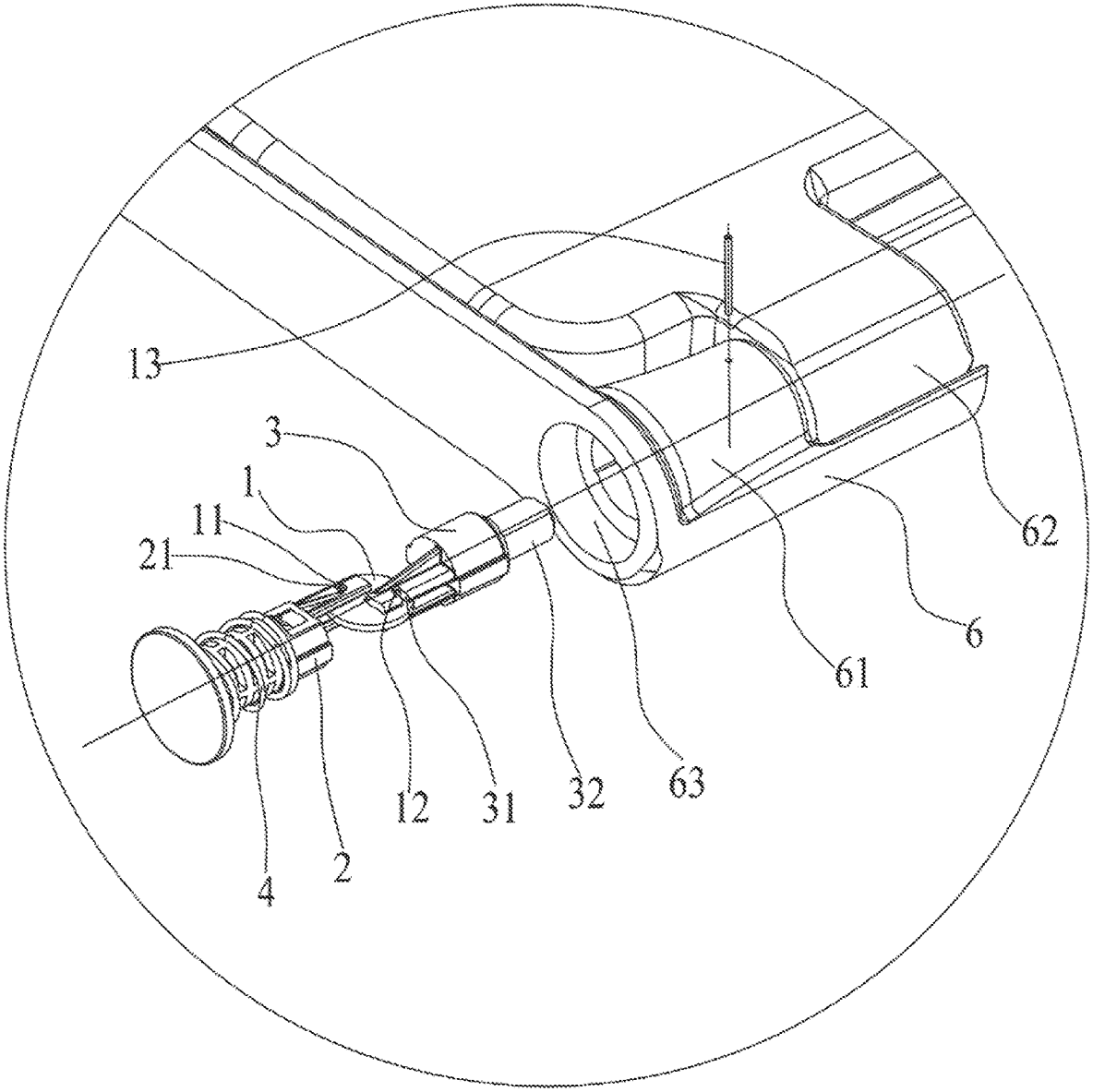
FIG. 8 is another assembly schematic diagram of the device for rapidly disassembling a toilet lid and the toilet lid according to Embodiment 1 of the present disclosure.

FIG. 8 is an assembly schematic diagram of the device for rapidly disassembling a toilet lid and the toilet lid when the device does not include the fixing sleeve 5. The toilet lid 6 includes an upper cover 61 and a toilet seat 62 which are both provided with axial mounting holes 63, the rotating member 1, the push rod 2 and the pull rod 3 are accommodated in the axial mounting holes 63, the pin 13 is fixed in the axial mounting hole 63 of the upper cover 61, the rotating member 1 is arranged in the axial mounting hole 63 of the upper cover 61 and rotates around the pin 13, the push rod 2 is axially movably arranged in the axial mounting hole 63 of the upper cover 61. The pull rod 3 is axially movably arranged in the axial mounting hole 63 of the toilet seat 62, and the rotating shaft 32 of the pull rod 3 may stretch out of the axial mounting hole 63. One end of the elastic member 4 abuts against the side wall of the axial mounting hole 63 of the upper cover 61, and the other end of the elastic member 4 abuts against the push rod 2.

Optionally, the device for rapidly disassembling a toilet lid further includes the fixing sleeve 5, an axial through hole 51 is formed in the fixing sleeve 5, the rotating member 1, the push rod 2 and the pull rod 3 are accommodated in the through hole 51 to form a whole, one end of the elastic member 4 abuts against the fixing sleeve 5, and the other end of the elastic member 4 abuts against the push rod 2.

Figure 6:
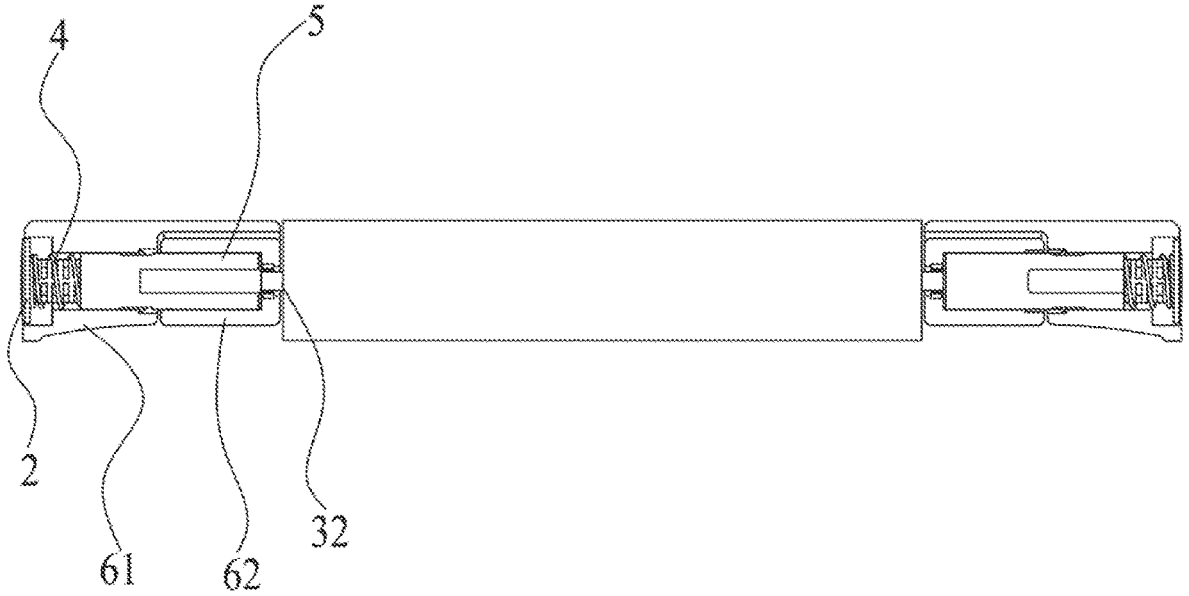
FIG. 6 is an assembly schematic diagram (in the state that the rotating shaft stretches out) of a device for rapidly disassembling a toilet lid and a toilet lid according to Embodiment 1 of the present disclosure.
Figure 7:
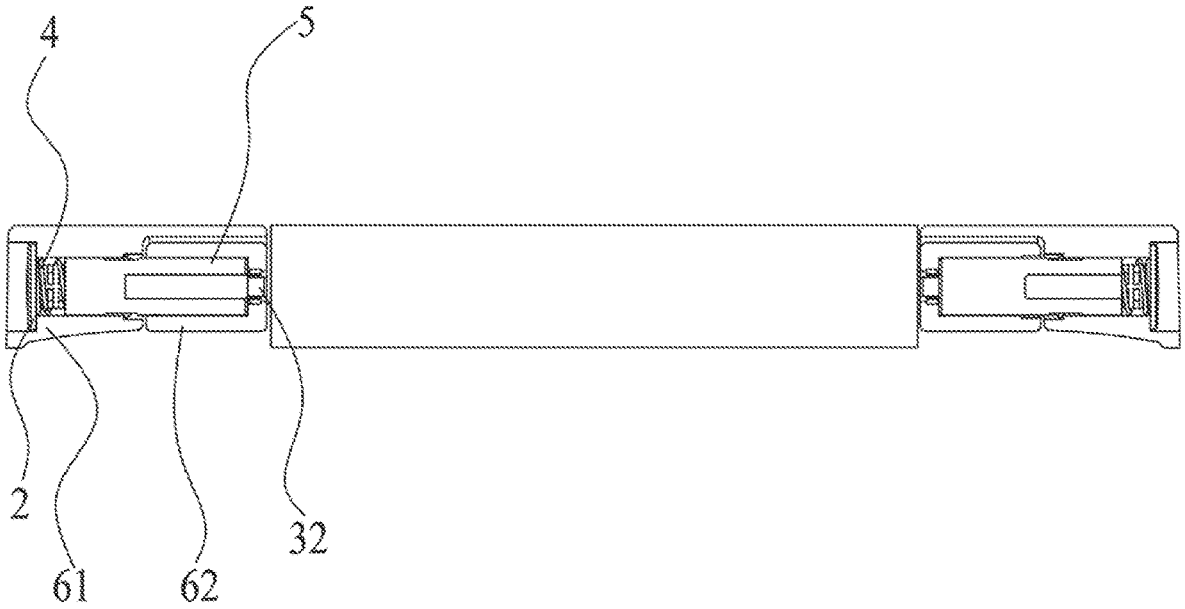
FIG. 7 is an assembly schematic diagram (in the state that the rotating shaft draws back) of the device for rapidly disassembling a toilet lid and the toilet lid according to Embodiment 1 of the present disclosure.

FIGS. 6 and 7 are assembly schematic diagrams of the device for rapidly disassembling a toilet lid and the toilet lid when the device includes the fixing sleeve 5. The axial through hole 51 is formed in the fixing sleeve 5, the rotating member 1, the push rod 2 and the pull rod 3 are accommodated in the through hole 51, the pin 13 is fixed in the fixing sleeve 5, the toilet lid 6 includes the upper cover 61 and the toilet seat 62 which are both provided with the axial mounting holes 63, and the fixing sleeve 5 is arranged in the axial mounting holes 63.

Figure 9:
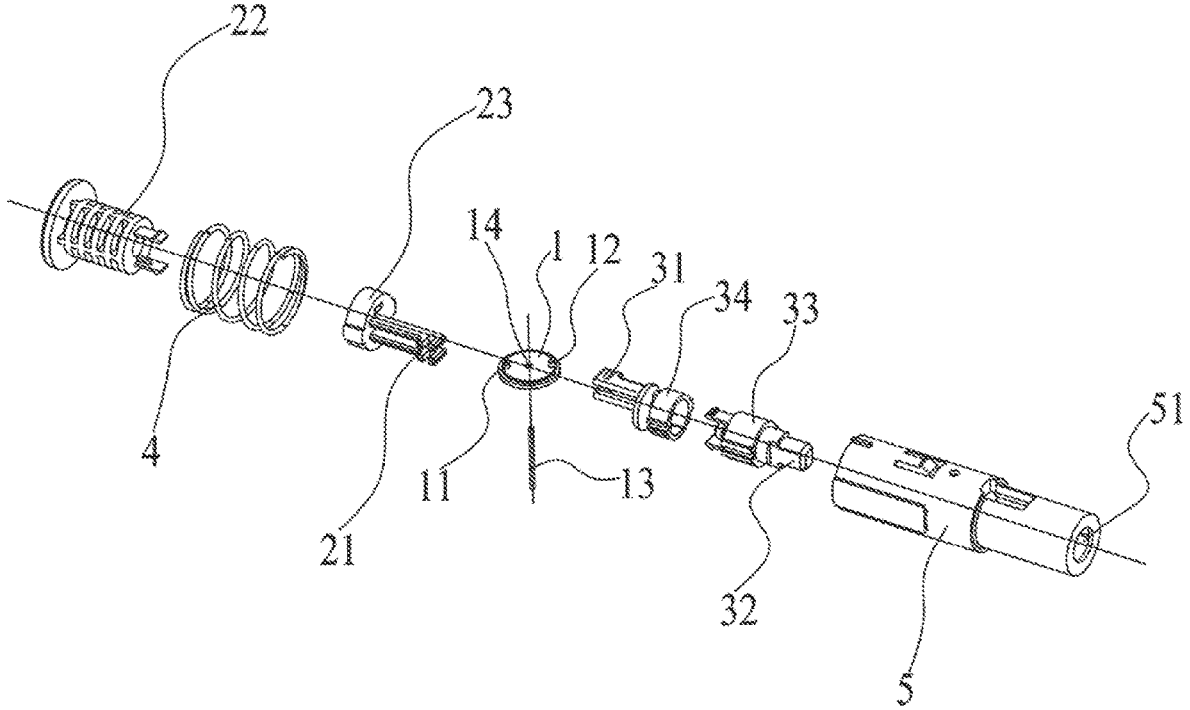
FIG. 9 is a three-dimensional exploded view according to Embodiment 2 of the present disclosure.

As shown in FIG. 9, a device for rapidly disassembling a toilet lid disclosed in Embodiment 2 of the present disclosure includes the rotating member 1, the push rod 2, the pull rod 3 and the elastic member 4. Differences between Embodiment 2 and Embodiment 1 are:

Optionally, the push rod 2 is separately arranged and includes a button 22 and a first claw 23 which are fixedly connected, and the first claw 23 is provided with the first transverse sliding groove 21. Specifically, the button 22 and the first claw 23 are fixedly connected by matching of a hook and a clamp hole, such that processing is convenient. A surface of the button 22 may be treated, and a surface of the first claw 23 is not treated, such that processing cost is saved.

Optionally, the pull rod 3 is separately arranged and includes a connecting rod 33 and a second claw 34 which are fixedly connected, the connecting rod 33 is provided with the rotating shaft 32, and the second claw 34 is provided with the second transverse sliding groove 31. Specifically, the connecting rod 33 and the second claw 34 are fixedly connected by matching of a hook and a clamp groove, such that processing is convenient, and different functions are realized. For example, in some examples, the rotating shaft 32 may be made of metal.

Of course, the push rod 2 may be separately arranged and the pull rod 3 is integrally arranged, or the push rod 2 may be integrally arranged and the pull rod 3 is separately arranged.

According to the device for rapidly disassembling a toilet lid of the embodiment of the present disclosure, the push rod 2 axially moves towards the first direction to drive the rotating member 1 to rotate, for example, when the push rod 2 axially moves towards the pull rod 3, the first transverse sliding groove 21 of the push rod 2 pushes the first sliding rod 11 to drive the rotating member 1 to rotate, the rotating member 1 drives the second sliding rod 12 to rotate, the second sliding rod 12 pushes the second transverse sliding groove 31 of the pull rod 3 so as to pull the pull rod 3 to axially move in the second direction opposite the first direction, that is, the pull rod 3 axially moves towards the push rod 1, and then the rotating shaft 32 of the pull rod 3 draws back to rapidly disassemble the toilet lid 6. Under the circumstance that the elastic member 4 acts on the push rod 2, the push rod 2 axially moves towards the first direction to drive the rotating member 1 to rotate, for example, when the push rod 2 axially moves away from the pull rod 3, the first transverse sliding groove 21 of the push rod 2 pushes the first sliding rod 11 to drive the rotating member 1 to rotate, the rotating member 1 drives the second sliding rod 12 to rotate, the second sliding rod 12 pushes the second transverse sliding groove 31 of the pull rod 3 so as to pull the pull rod 3 to axially move in the second direction opposite the first direction, that is, the pull rod 3 axially moves away from the push rod 2, and then the rotating shaft 32 of the pull rod 3 stretches out to rapidly assemble the toilet lid 6 to the toilet bowl. Therefore, according to the present disclosure, the push rod 2 acts on the rotating member 1, and the rotating member 1 acts on the pull rod 3 to drive the rotating shaft 32 to stretch out or draw back, so as to rapidly assemble or disassemble the toilet lid and the toilet bowl.

As shown in FIGS. 6 and 8, the present disclosure further discloses a toilet lid, an axial mounting hole 61 is provided in the toilet lid 6, and the device for rapidly disassembling a toilet lid is arranged in the axial mounting hole 61. As shown in FIG. 8, when the device for rapidly disassembling a toilet lid does not include the fixing sleeve 5, the toilet lid 6 includes the upper cover 61 and the toilet seat 62 which are both provided with axial mounting holes 63, the rotating member 1, the push rod 2 and the pull rod 3 are accommodated in the axial mounting holes 63, the pin 13 is fixed in the axial mounting hole 63 of the upper cover 61, the rotating member 1 is arranged in the axial mounting hole 63 of the upper cover 61 and rotates around the pin 13, and the push rod 2 is axially movably arranged in the axial mounting hole 63 of the upper cover 61. The pull rod 3 is axially movably arranged in the axial mounting hole 63 of the toilet seat 62, and the rotating shaft 32 of the pull rod 3 may stretch out of the axial mounting hole 63. One end of the elastic member 4 abuts against the side wall of the axial mounting hole 63 of the upper cover 61, and the other end of the elastic member 4 abuts against the push rod 2.

As shown in FIGS. 6 and 7, when the device for rapidly disassembling a toilet lid includes the fixing sleeve 5, the axial through hole 51 is formed in the fixing sleeve 5, the rotating member 1, the push rod 2 and the pull rod 3 are accommodated in the through hole 51, the pin 13 is fixed in the fixing sleeve 5, the toilet lid 6 includes the upper cover 61 and the toilet seat 62 which are both provided with the axial mounting holes 63, and the fixing sleeve 5 is arranged in the axial mounting holes 63.

Optionally, the rotating member 1 is set as a gear, the push rod 2 is provided with a first rack meshing with the first connecting position of the rotating member 1, and one end of the pull rod 3 is provided with a second rack meshing with the second connecting position of the rotating member 1.

Optionally, the rotating member 1 is set as a rotating rod, the middle portion of the rotating member 1 is rotatable, one end of the rotating member 1 is hinged with the push rod 2, and the other end of the rotating member 1 is hinged with one end of the pull rod 3.

In the description of the present disclosure, it should be understood that terms "center", "longitudinal", "transverse", "length", "width", "thickness", "above", "below", "front", "back", "left", "right", "vertical", "horizontal", "top", "bottom", "inner", "outer", "clockwise", "counterclockwise", etc. indicate azimuthal or positional relations based on those shown in the accompanying drawings only for ease of description of the present disclosure and for simplicity of description, and are not intended to indicate or imply that the referenced device or element must have a particular orientation and be constructed and operative in a particular orientation, and thus may not be construed as a limitation on the present disclosure.

In addition, terms "first" and "second" are for descriptive purposes only and are not to be construed as indicating or implying their relative importance or implicitly specifying the number of indicated technical features. Thus, a feature defined with "first" and "second" may explicitly or implicitly include at least one of the features. In the description of the present disclosure, "plurality" means two or more, unless expressly specified otherwise.

In the present disclosure, unless expressly specified otherwise, terms "installation", "connected" "connection", "fixation", etc. are to be construed broadly. For example, a connection may be a fixed connection, a detachable connection or an integrated connection; may be a mechanical connection or an electrical connection"; may be a direct connection or an indirect connection via an intermediary medium; or may be communication in two elements or an interworking relation between two elements. The specific meanings of the above terms in the present disclosure may be understood on a case-by-case basis for those of ordinary skill in the art.

In the present disclosure, unless expressly specified and limited otherwise, the situation that a first feature is "above" or "below" a second feature may be that the first and second features are in direct contact, or may be that the first and second features are not in direct contact but are in contact by means of an another feature between them. Moreover, the situations that the first feature is "above", "at an upper portion of" and "at an upside of" the second feature include the situations that the first feature is right above or obliquely above the second feature, or simply indicate that the first feature is at a higher level than the second feature. The situations that the first feature is "below", "at a lower portion of" and "at an underside of" the second feature include the situations that the first feature is right below or obliquely below the second feature, or simply indicate that the first feature is at a lower level than the second feature.

In the description of the description, description with reference to terms such as "an embodiment", "some embodiments", "examples", "particular examples", or "some examples" means that specific features, structures, materials, or characteristics described in combination with the embodiment(s) or example(s) are included in at least one embodiment or example of the present disclosure. In the description, the schematic expressions of the terms mentioned above are not be construed as being necessarily directed to the same embodiment or example. Moreover, the specific features, structures, materials or characteristics described may be combined in a suitable manner in any one or more embodiments or examples. In addition, those skilled in the art may bind and combine different embodiments or examples described in the description.

While the embodiments of the present disclosure have been shown and described above, it should be understood that the above embodiments are exemplary and not to be construed as limiting the present disclosure, and variations, modifications, substitutions and alterations to the above embodiments may be made by those skilled in the art within the scope of the present disclosure.

What is claimed is:

1. A device for rapidly disassembling a toilet lid, comprising:

a rotating member, wherein the rotating member is rotatably arranged;

a push rod, where the push rod is axially movably arranged on a first side of the rotating member and the push rod is connected to a first connecting position of the rotating member;

a pull rod, wherein the pull rod is axially movably arranged on a second side, opposite the first side, of the rotating member, a first end of the pull rod is connected to a second connecting position of the rotating member, a second end of the pull rod is provided with a rotating shaft connected to a toilet bowl, and when the push rod axially moves towards a first direction to drive the rotating member to rotate, the rotating member pulls the pull rod to axially move towards a second direction opposite the first direction; and an elastic member, wherein the elastic member acts on the push rod to provide a return force for the push rod, wherein the rotating member is set as a rotating disc, a first sliding rod and a second sliding rod are arranged, in an axial direction, on the rotating member separately, a first transverse sliding groove is provided on the push rod, and the first end of the pull rod is provided with a second transverse sliding groove, the first sliding rod slides in the first transverse sliding groove, and the second sliding rod slides in the second transverse sliding groove.

2. The device according to claim 1, wherein the rotating member rotates around a pin fixedly arranged.

3. The device according to claim 1, wherein a connecting line between the first sliding rod and the second sliding rod is connected to a rotation center of the rotating member, and the first sliding rod and the second sliding rod are positioned at two sides of the rotation center of the rotating member respectively.

4. The device according to claim 1, wherein the push rod is separately arranged and comprises a button and a first claw, wherein the button and the first claw are connected fixedly to each other, and the first transverse sliding groove is provided in the first claw.

5. The device according to claim 1, wherein the pull rod is separately arranged and comprises a connecting rod and a second claw, wherein the connecting rod and the second claw are connected fixedly to each other, the rotating shaft is arranged on the connecting rod, and the second transverse sliding groove is provided in the second claw.

6. The device according to claim 1, wherein the first transverse sliding groove and the second transverse sliding groove are open grooves.

7. The device according to claim 1, wherein the first transverse sliding groove and the second transverse sliding groove are closed grooves.

8. The device according to claim 1, wherein a width of the first transverse sliding groove is greater than or equal to a distance between the second sliding rod and a rotation center of the rotating member, and a width of the second transverse sliding groove is greater than or equal to a distance between the first sliding rod and the rotation center of the rotating member.

9. The device according to claim 1, wherein the device further comprises a fixing sleeve, an axial through hole is formed in the fixing sleeve; the rotating member, the push rod, and the pull rod are accommodated in the axial through hole, a first end of the elastic member abuts against the fixing sleeve, and a second end of the elastic member abuts against the push rod.

10. The toilet lid, wherein an axial mounting hole is provided in the toilet lid, and the device for rapidly disassembling the toilet lid according to claim 9 is arranged in the axial mounting hole.

11. The toilet lid, wherein an axial mounting hole is provided in the toilet lid, and the device for rapidly disassembling the toilet lid according to claim 1 is arranged in the axial mounting hole.

12. The device according to claim 2, wherein the device further comprises a fixing sleeve, an axial through hole is formed in the fixing sleeve; the rotating member, the push rod, and the pull rod are accommodated in the axial through hole, a first end of the elastic member abuts against the fixing sleeve, and a second end of the elastic member abuts against the push rod.

13. The device according to claim 3, wherein the device further comprises a fixing sleeve, an axial through hole is formed in the fixing sleeve; the rotating member, the push rod, and the pull rod are accommodated in the axial through hole, a first end of the elastic member abuts against the fixing sleeve, and a second end of the elastic member abuts against the push rod.

14. The device according to claim 4, wherein the device further comprises a fixing sleeve, an axial through hole is formed in the fixing sleeve; the rotating member, the push rod, and the pull rod are accommodated in the axial through hole, a first end of the elastic member abuts against the fixing sleeve, and a second end of the elastic member abuts against the push rod.

* * * * *